US009776198B2

(12) United States Patent
Scherer

(10) Patent No.: US 9,776,198 B2
(45) Date of Patent: Oct. 3, 2017

(54) SYSTEM FOR DISPENSING A MIXTURE OF A FIRST PRODUCT AND A SECOND PRODUCT

(71) Applicant: ALBEA THOMASTON INC., Thomaston, CT (US)

(72) Inventor: Christopher Scherer, Orange, CT (US)

(73) Assignee: Albea Thomaston Inc., Thomaston, CT (US)

( * ) Notice: Subject to any disclaimer, the term of this patent is extended or adjusted under 35 U.S.C. 154(b) by 197 days.

(21) Appl. No.: 14/730,415

(22) Filed: Jun. 4, 2015

(65) Prior Publication Data

US 2015/0367368 A1 Dec. 24, 2015

(30) Foreign Application Priority Data

Jun. 18, 2014 (EP) ..... 14173021

(51) Int. Cl.
*B05B 11/00* (2006.01)
*B05B 15/00* (2006.01)
(Continued)

(52) U.S. Cl.
CPC ..... *B05B 11/3081* (2013.01); *B05B 11/0078* (2013.01); *B05B 11/3001* (2013.01);
(Continued)

(58) Field of Classification Search
CPC ..... B05B 11/3081; B05B 11/0078; B05B 11/3001; B05B 11/3047; B05B 11/0037;
(Continued)

(56) References Cited

U.S. PATENT DOCUMENTS 4,821,923 A 4/1989 Skorka
5,273,189 A 12/1993 Jouillat et al.
(Continued)

FOREIGN PATENT DOCUMENTS

WO 0130668 5/2001

OTHER PUBLICATIONS

European Patent Application No. 14 17 3021, Search Report, dated Nov. 27, 2014.

*Primary Examiner* — Frederick C Nicolas
(74) *Attorney, Agent, or Firm* — Banner & Witcoff, Ltd.

(57) ABSTRACT

A system for dispensing a mixture of a first product and a second product has a pump which presents a pump body that is intended to be connected to a bottle which contains the first product. The pump has a piston secured to a push button so as to be actuated in translatory motion in the body. The piston defines within the body a dosing chamber having a feeding inlet formed on a lower part of the body. The pump further has a lower check valve that is slidingly mounted in the dosing chamber between an upper opening position and a lower closing position of the feeding inlet. The system further has an additional container (attached to the body which is intended to contain the second product, an organ for opening the additional container being coupled with the check valve in order to, at least upon the first actuation of the pump, open the additional container by the movement of the lower check valve towards its closing position, the opening being configured for the mixing of the second product with the first product into the bottle.

18 Claims, 2 Drawing Sheets

(51) Int. Cl.
*B65D 81/32* (2006.01)
*B65D 51/28* (2006.01)
*B65D 25/08* (2006.01)

(52) U.S. Cl.
CPC ..... *B05B 11/3047* (2013.01); *B05B 15/005* (2013.01); *B05B 11/0037* (2013.01); *B05B 11/0081* (2013.01); *B65D 25/085* (2013.01); *B65D 51/2835* (2013.01); *B65D 51/2842* (2013.01); *B65D 81/3216* (2013.01)

(58) Field of Classification Search
CPC ..... B05B 11/0081; B05B 15/005; B65D 51/2835; B65D 51/2842; B65D 81/3216; B65D 25/085
See application file for complete search history.

(56) References Cited

U.S. PATENT DOCUMENTS

| | | | | |
|---|---|---|---|---|
| 5,642,838 | A * | 7/1997 | Stoody | B05B 11/0043 222/105 |
| 6,412,659 | B1 * | 7/2002 | Kneer | B05B 11/0037 222/105 |
| 7,367,709 | B2 * | 5/2008 | Ki | B05B 11/0081 206/221 |
| 8,267,280 | B2 * | 9/2012 | Kneer | B05B 11/0078 206/222 |
| 2007/0228074 | A1 | 10/2007 | Mueller et al. | |

* cited by examiner

SYSTEM FOR DISPENSING A MIXTURE OF A FIRST PRODUCT AND A SECOND PRODUCT

CROSS REFERENCE TO RELATED APPLICATION

This application claims priority to European Patent Application Serial No. 14173021.8, filed Jun. 18, 2014, which is hereby incorporated by reference in its entirety.

FIELD

The invention relates to a system for dispensing a mixture of a first product and a second product, at least one of said products possibly being perfumes, cosmetic products or pharmaceutical products.

BACKGROUND

Bottles equipped with product dispensing systems are known, wherein a first and a second product are stored separately before the first use of said bottle, said products being mixed together in the container of said bottle just before said first use, notably upon specific manipulations that are performed by the user.

U.S. Pat. No. 5,957,335 describes an additional container for storing an active agent which is formed in a wall to be fitted in the neck of a bottle wherein a diluting agent is stored, said additional container comprising an organ above which a dispensing system is intended to be mounted, so that, as said dispensing system is screwed on the neck of the bottle, said organ opens said additional container for the mixing of the active agent with the diluting agent into the bottle just before the first use of said bottle.

However, such a realisation is not totally satisfactory, notably as it requires the assembly of the additional container and of the dispensing system with the bottle, which constitutes a relatively complex and non-intuitive manipulation.

U.S. Pat. No. 4,613,061 describes a dispensing system comprising a valve which presents a body that is rigidly connected to an aerosol bottle wherein a first product is stored, such as a jet to be secured to a push button so as to be actuated in translatory motion in said body. Moreover, the valve body is equipped with an additional container for storing a second product that is formed in a wall attached to said valve body.

In particular, the additional container is initially closed by a frangible membrane and the jet of the valve is initially secured to a protective cap. Before the first use of the bottle, the user presses the protective cap so as to move the jet towards the membrane, said jet being arranged to break said membrane, and thus to open the additional container upon the first actuation of said jet.

However, this solution is also not totally satisfactory, as it requires additional manipulations of the user for making the bottle ready to use. Indeed, once the membrane is broken, the user must turn the bottle upside down and check it, so that the second product flows out of the additional container to be mixed with the first product into the bottle. Then, the user must replace the protective cap by a push button.

SUMMARY

The invention aims to improve the prior art by proposing a system for dispensing a mixture of first and second products that is easy to use and manufacture, while being intuitive to use and adapted to be used with many types of bottles.

For that purpose, the invention relates to a system for dispensing a mixture of a first product and a second product, said system comprising a pump which presents a pump body that is intended to be connected to a bottle which contains the first product, said pump comprising a piston secured to a push button so as to be actuated in translatory motion in said body, said piston defining within said body a dosing chamber having a feeding inlet formed on a lower part of said body, said pump further comprising a lower check valve that is slidingly mounted in the dosing chamber between an upper opening position and a lower closing position of the feeding inlet, said system further comprising an additional container attached to the body which is intended to contain the second product, an organ for opening said additional container being coupled with said lower check valve in order to, at least upon the first actuation of the pump, open said additional container by the movement of the lower check valve towards its closing position, said opening being configured for the mixing of said second product with said first product into said bottle.

BRIEF DESCRIPTION OF THE DRAWINGS

Other aspects and advantages of the invention will become apparent in the following description made with reference to the appended figures, wherein.

DETAILED DESCRIPTION

In relation to those figures, a system for dispensing a mixture of a first product and a second product will be described below. As an application example, at least one of the products are perfumes, cosmetic products or pharmaceutical products.

The system comprises a pump which presents a pump body 1 that is intended to be rigidly connected to a bottle which contains a first product. In the figures, the pump comprises a cap 2 and a sealing collar 3 for its mounting on the neck of a bottle (not shown).

In particular, the cap 2 can be made of aluminium and comprises a peripheral skirt 2*a* which is intended to be deformed so as to conform in shape to the forms of the association zone of the neck in order to lock the pump axially and radially relative to the bottle. In other embodiments, the cap 2 may include a geometry and/or configurations of association means on the neck of the bottle which are different.

Figure 1:
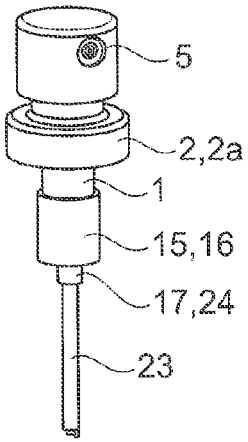
FIG. 1 represents in perspective a system according to an embodiment of the invention.
Figure 2A:
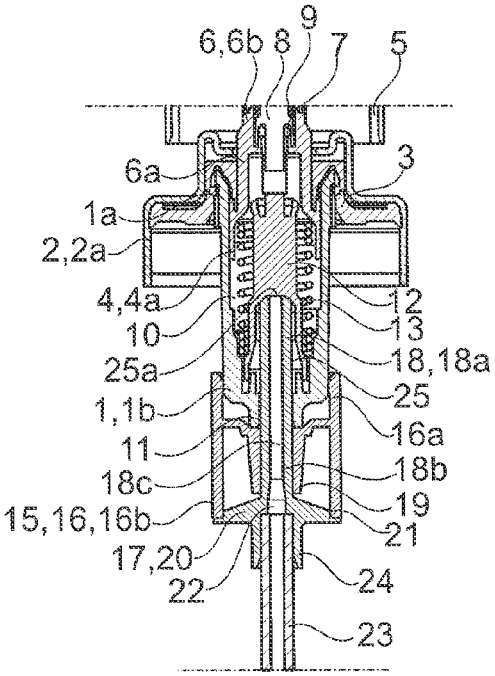
FIG. 2*a* represents in partial longitudinal cross section the system of FIG. 1, respectively with the piston in release position of the pump.
Figure 2B:
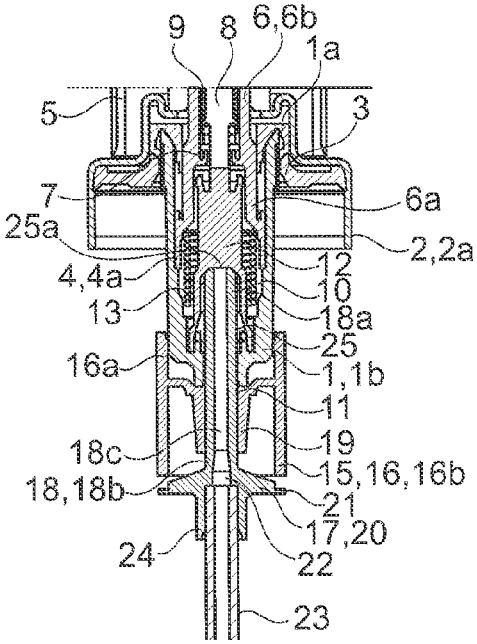
FIG. 2*b* represents in partial longitudinal cross section the system of FIG. 1, respectively with the piston in actuated position of the pump.
Figure 3:
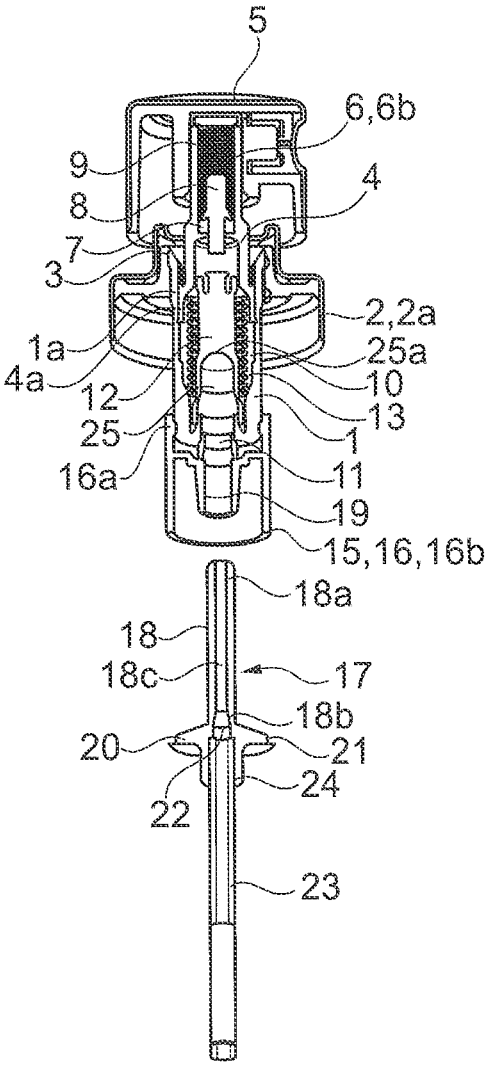
FIG. 3 represents in longitudinal cross section the system of FIGS. 1, 2*a*, 2*b* with the opening organ disassembled.

The pump further comprises a piston 4 secured to a push button 5, so as to be actuated by the user in translatory motion in the pump body 1 between a release position (FIG. 2*a*) and an actuation position (FIG. 2*b*), along a descending dispensing stroke and an ascending suction stroke.

The piston 4 comprises an upper tube 6 that is secured to the push button 5. In the figures, the piston 4 is made integral with the upper tube 6 and comprises a cylindrical surface 4*a* that extends from a lower end of said upper tube and that comes in frictional contact on at least a part of its high against an inner wall of the pump body 1. According to a variant, the piston 4 and the upper tube 6 can be made from different pieces, the piston 4 being attached to a lower end of the upper tube 6.

The piston 4 defines within the pump body 1 a dosing chamber 10 having a feeding inlet 11 formed on a lower part of said body. On the other hand, the upper tube 6 comprises a dispensing outlet 7 wherein an upper check valve 8 is slidingly mounted for reversibly opening said dispensing outlet upon actuation of the piston 4.

In particular, the upper tube 6 comprises a lower portion 6*a* on a lower end of which the piston 4 is attached, such as an upper portion 6*b* on an upper end of which the push button 5 is secured, the dispensing outlet 7 extending between said upper and lower portions within said upper tube.

In the represented embodiment, the upper check valve 8 is slidingly mounted in the dispensing outlet 7 between a lower closing position (FIG. 2*a*)—notably when the piston 4 is moved on its suction stoke—and an upper opening position of said outlet (FIG. 2*b*)—when the piston is actuated on its dispensing stoke. Furthermore, a return spring 9 is mounted around the upper check valve 8 in the upper portion 6*b* for allowing the return of said upper check valve in its lower closing position after the actuation of the pump.

The pump further comprises a lower check valve 12 that is slidingly mounted in the dosing chamber 10 between an upper opening position (FIG. 2*a*)—notably when the piston 4 is moved on its suction stroke—and a lower closing position of the feeding inlet 11 (FIG. 2*b*)—when the piston 4 is actuated on its dispensing stroke. Furthermore, a return spring 13 is mounted around the lower check valve 12 in the dosing chamber 10 for allowing the return of said lower check valve in its upper opening position after the actuation of the pump.

The system further comprises an additional container 15 attached to the body 1 which is intended to contain a second product, the mixture of first and second products being intended to be dispensed by actuation of the pump.

In relation to the figures, the additional container 15 comprises a wall 16 that is fixedly mounted around at least a lower portion 1*b* of the pump body 1. In particular, the wall 16 comprises an upper cylindrical portion 16*a* that is mounted in serrated contact around the lower portion 1*b* of the pump body 1, notably through an annular bead that protrudes radially from an internal surface of said upper portion. The additional container comprises also a lower portion 16*b* within which the second product is intended to be stored.

The system further comprises an organ 17 for opening the additional container 15, said organ being coupled to the lower check valve 12 in order to, at least upon the first actuation of the pump, open said additional container by the movement of the lower check valve 12 towards its closing position, said opening being configured for the mixing of the second product with the first product into the bottle.

In relation to the figures, the organ 17 comprises a tube 18 that is slidingly mounted in the feeding inlet 11 of the pump body 1. The tube 18 comprises an upper part 18*a* which is arranged in bearing contact under the lower check valve 12, so that said tube will be moved down into said feeding inlet upon the movement of said lower check valve towards its closing position.

More precisely, the lower check valve 12 comprises a lower housing 25 wherein the upper part 18*a* is arranged, said lower housing comprising an internal surface 25*a* on the top of which the end of the upper part 18*a* is arranged in bearing contact.

In particular, the tube 18 is mounted in a sealing manner into the feeding inlet 11, the lower check valve 12 in closing position being in sealing contact around said inlet by means of the free lower end of the internal surface 25*a*. The tube 18 has a pipe 18*c* that extends from the upper part 18*a* to a lower part 18*b* of said tube in order to put the dosing chamber 10 in fluid communication with the bottle. Thus, the chamber 10 is feed through the pipe 18*c* of the tube 18 when the lower check valve 12 is in its opening position.

In relation to the figures, the additional container 15 comprises an inner central well 19 that is arranged between the upper 16*a* and lower 16*b* portions of the wall 16, the tube 18 being also mounted slidingly within said well.

The organ 17 further comprises a plate 20 that interacts with a lower end of the wall 16 for closing the additional container 15 when the lower check valve 12 is in its upper opening position, the lower end 18*b* of the tube 18 interacting with said plate for opening the additional container 15 at least upon the first actuation of the pump, so that the second product will flow under gravity out of said additional container into said bottle.

In the represented embodiment, the lower portion 16*b* of the wall 16 comprises a lower end wherein the plate 20 is arranged in serrated contact for closing the additional container 15 before the first actuation of the pump.

To do so, the plate 20 comprises an annular groove 21 wherein the lower end of the lower portion 16*b* is arranged in bearing contact for closing the additional container 15 before the first actuation of the pump. According to an embodiment, the tube 18 can be attached to the lower check valve 12, so that the plate 20 is constrained in a position for closing the container 15 by the return spring 13 of said lower check valve.

The plate 20 can be initially fixed to the lower end of the lower portion 16*b* through frangible links, said frangible links being intended to be broken upon the first actuation of the pump for opening the additional container 15.

The plate 20 further comprises a duct 22 on which the tube 18 is fixed with the lower part 18*b* in communication with said duct, so as to allow the fluid communication of the tube 18 with the bottle through the plate 20 for feeding the dosing chamber 10.

In the embodiment shown, the tube 18 and the plate 20 are made integral, the lower part 18*b* being formed within the duct 22. According to a variant, the organ 17 can comprise a tube 18 and a plate 20 that are made from separated pieces, the duct 22 of said plate being attached to the lower part 18*b* of said tube.

In particular, the plate 20 remains attached to the organ 17 even after the first actuation of the piston 4 and the consecutive mixing of the two products into the bottle. Thus, the additional container 15 will be open upon each actuation of the pump and will be closed upon each release of said pump.

Moreover, the system comprises a dip tube 23 that is connected below the duct 22, so as to allow the fluid communication of the tube 18 with the bottle, and thus the feeding of the dosing chamber 10. To do so, the plate 20 comprises a lower mounting well 24 that extends below the duct 22 and within which the upper end of a dip tube 23 is fitted.

I claim:

1. System for dispensing a mixture of a first product and a second product, said system comprising a pump which presents a pump body that is intended to be connected to a bottle which contains the first product, said pump comprising a piston secured to a push button so as to be actuated in translatory motion in said body, said piston defining within said body a dosing chamber having a feeding inlet formed on a lower part of said body, said pump further comprising a lower check valve that is slidingly mounted in the dosing chamber between an upper opening position and a lower closing position of the feeding inlet, said system further comprising an additional container attached to the body which is intended to contain the second product, an organ for opening said additional container being coupled with said lower check valve in order to, at least upon the first actuation of the pump, open said additional container by movement of the lower check valve towards a closing position, said opening being configured for mixing of said second product with said first product into said bottle.

2. System according to claim 1, wherein the additional container comprises a wall that is fixedly mounted around at least a lower portion of the pump body.

3. System according to claim 2, wherein the organ comprises a plate that interacts with a lower end of the wall for closing the additional container when the lower check valve is in an upper position.

4. System according to claim 3, wherein the plate is initially fixed to the lower end of the wall through frangible links, said frangible links being intended to be broken upon the first actuation of the pump for opening the additional container.

5. System according to claim 1, wherein the organ comprises a tube that is slidingly mounted in the feeding inlet, said tube comprising an upper part which is arranged in bearing contact under the lower check valve, said tube having a pipe extending from the upper part to a lower part of said tube in order to put the dosing chamber in fluid communication with the bottle.

6. System according to claim 3, wherein the plate comprises a duct on which the tube is fixed with the lower part in communication with the duct.

7. System according to claim 6, wherein the plate is made integral with the tube, the lower part being formed within the duct.

8. System according to claim 6, further comprising a dip tube that is connected below the duct.

9. System according to claim 1, wherein the pump comprises a return spring mounted for allowing the return of the lower check valve in an upper opening position after actuation of said pump.

10. System according to claim 1, wherein the piston comprises an upper tube that is secured to the push button, the upper tube comprising a dispensing outlet wherein an upper check valve is mounted for reversibly opening said dispensing outlet upon actuation of the pump.

11. System according to claim 5, wherein the plate comprises a duct on which the tube is fixed with the lower part in communication with the duct.

12. System according to claim 11, wherein the plate is made integral with the tube, the lower part being formed within the duct.

13. System according to claim 11, further comprising a dip tube that is connected below the duct.

14. System according to claim 7, further comprising a dip tube that is connected below the duct.

15. System according to claim 12, further comprising a dip tube that is connected below the duct.

16. System according to claim 2, wherein the organ comprises a tube that is slidingly mounted in the feeding inlet, said tube comprising an upper part which is arranged in bearing contact under the lower check valve, said tube having a pipe extending from the upper part to a lower part of said tube in order to put the dosing chamber in fluid communication with the bottle.

17. System according to claim 3, wherein the organ comprises a tube that is slidingly mounted in the feeding inlet, said tube comprising an upper part which is arranged in bearing contact under the lower check valve, said tube having a pipe extending from the upper part to a lower part of said tube in order to put the dosing chamber in fluid communication with the bottle.

18. System according to claim 4, wherein the organ comprises a tube that is slidingly mounted in the feeding inlet, said tube comprising an upper part which is arranged in bearing contact under the lower check valve, said tube having a pipe extending from the upper part to a lower part of said tube in order to put the dosing chamber in fluid communication with the bottle.

* * * * *